US005621426A

United States Patent [19]

Okada et al.

[11] Patent Number: 5,621,426

[45] Date of Patent: Apr. 15, 1997

[54] DISPLAY APPARATUS AND DRIVING CIRCUIT FOR DRIVING THE SAME

[75] Inventors: Hisao Okada, Nara-ken; Tadatsugu Nishitani, Amagasaki; Toshihiro Yanagi, Nara, all of Japan

[73] Assignee: Sharp Kabushiki Kaisha, Osaka, Japan

[21] Appl. No.: 446,064

[22] Filed: May 19, 1995

Related U.S. Application Data

[63] Continuation of Ser. No. 210,451, Mar. 21, 1994, abandoned.

[30] Foreign Application Priority Data

Mar. 24, 1993 [JP] Japan ..... 5-065383

[51] Int. Cl.[6] ..... G09G 3/36

[52] U.S. Cl. ..... 345/95; 345/89; 345/98

[58] Field of Search ..... 345/89, 99, 100, 345/95, 98, 210

[56] References Cited

U.S. PATENT DOCUMENTS

| | | | |
|---|---|---|---|
| 3,955,187 | 5/1976 | Bigelow | 345/94 |
| 4,297,004 | 10/1981 | Nishimura . | |
| 4,348,666 | 9/1982 | Ogita | 345/147 |
| 4,570,115 | 2/1986 | Misawa . | |
| 4,745,403 | 5/1988 | Tamura | 345/101 |
| 4,752,774 | 6/1988 | Clerc et al. | 345/89 |
| 4,775,549 | 10/1988 | Ota et al. . | |
| 4,824,211 | 4/1989 | Murata | 345/94 |
| 4,834,510 | 5/1989 | Fujita | 345/97 |
| 4,870,398 | 9/1989 | Bos . | |
| 4,908,613 | 3/1990 | Green | 345/98 |
| 4,998,099 | 3/1991 | Ishii | 345/98 |
| 5,010,327 | 4/1991 | Wakita et al. | 345/89 |
| 5,066,945 | 11/1991 | Kanno et al. | 345/101 |
| 5,115,232 | 5/1992 | Iizuka | 345/99 |
| 5,162,786 | 11/1992 | Fukuda | 345/204 |
| 5,196,738 | 3/1993 | Takahara et al. . | |
| 5,214,417 | 5/1993 | Yamazaki . | |
| 5,266,936 | 11/1993 | Saitoh . | |
| 5,287,095 | 2/1994 | Kitazima et al. | 345/99 |
| 5,353,041 | 10/1994 | Miyamoto et al. | 345/100 |
| 5,367,314 | 11/1994 | Okada et al. | 345/98 |
| 5,402,142 | 3/1995 | Okada et al. | 345/95 |
| 5,440,323 | 8/1995 | Okada | 345/100 |

FOREIGN PATENT DOCUMENTS

| | | |
|---|---|---|
| 0071911 | 2/1983 | European Pat. Off. . |
| 0221307 | 5/1987 | European Pat. Off. . |
| 387550 | 9/1990 | European Pat. Off. . |
| 0391655 | 10/1990 | European Pat. Off. . |
| 6391655 | 10/1990 | European Pat. Off. . |

(List continued on next page.)

OTHER PUBLICATIONS

"A large, Full–Color TFT–LCD System for muti–media applications" H. Okada, ITEJ technical Report vol. 16. No. 11. pp. 67–72. (Jan. 1992).

"Driving Method for TFT/LCD Grayscale" IBM Technical Disclosure Bulletin, vol. 33 No. 6B Nov. 1990.

Okada et al, "TFT–LCDs Using Newly Designed 6–bit Digital Data Drivers", SID93 Digest, pp. 11–14, 1993.

Okada et al, "AN 8–bit Digital Data Driver For AMLCDs", SID 94 Digest, pp. 347–350, 1994.

Everitt, W.L., "Communication Engineering", McGraw–Hill, 2nd Ed. New York, 1937, pp. 241–247.

*Primary Examiner*—Richard Hjerpe
*Assistant Examiner*—Amare Mengistu
*Attorney, Agent, or Firm*—Nixon & Vanderhye PC

[57] ABSTRACT

A driving circuit for driving a display apparatus, includes: a control signal generating unit for generating a plurality of control signals in accordance with digital video data; a voltage signal output unit for receiving the plurality of control signals and selectively outputting at least one of a plurality of voltage signals supplied from a voltage supply unit in response to the plurality of control signals; and a signal delay unit, when a predetermined change occurs for each of the plurality of control signals, for transmitting the predetermined change to the voltage signal output unit with a predetermined period Δt delayed.

12 Claims, 12 Drawing Sheets

FOREIGN PATENT DOCUMENTS

| | | |
|---|---|---|
| 0478371 | 1/1992 | European Pat. Off. . |
| 0478386 | 4/1992 | European Pat. Off. . |
| 0484159 | 5/1992 | European Pat. Off. . |
| 06488516 | 6/1992 | European Pat. Off. . |
| 60-257683 | 12/1985 | Japan . |
| 2-264294 | 10/1990 | Japan . |
| 3-89392 | 4/1991 | Japan . |
| 3-89393 | 4/1991 | Japan . |
| 3-177890 | 8/1991 | Japan . |
| 4-69169 | 4/1992 | Japan . |
| 7-7248 | 1/1995 | Japan . |

DISPLAY APPARATUS AND DRIVING CIRCUIT FOR DRIVING THE SAME

This is a continuation of application Ser. No. 08/210,451, filed Mar. 21, 1994, now abandoned.

BACKGROUND OF THE INVENTION

1. Field of the Invention

The present invention relates to a driving circuit for a flat display apparatus and a driving method using the same. More particularly, the present invention relates to a display apparatus which receives a digital video signal to produce a display image with gray scales in accordance with the received digital video signals.

2. Description of the Related Art

FIG. 1 shows a data driver in a conventional driving circuit for driving a display apparatus which displays multiple gray scale images in accordance with digital video signals. For simplicity of explanation, it is herein assumed that the digital video data consists of two bits ($D_0$, $D_1$). This data driver supplies driving voltages to N pixels (where N is a positive integer) on a scanning line which has been selected by means of a scanning signal.

FIG. 2 shows a circuit which is a part of the data driver of FIG. 1. This circuit, which is denoted by the reference numeral 20, supplies a driving voltage through a data line to the n-th pixel (where n is an integer of 1 to N) of the above-mentioned N pixels provided along the single scanning line. The circuit 20 includes sampling flip-flops 21 each for receiving one bit of the digital video data ($D_0$, $D_1$), holding flip-flops 22, a decoder 23, and four analog switches 24 to 27. To the analog switches 24 to 27, signal voltages $V_0$ to $V_3$ are respectively supplied from four different voltage sources. As the sampling flip-flops 21, D flip-flops or various other flip-flops can be used.

Hereinafter, the operation of the circuit 20 of FIG. 2 is described below. At a rising edge of a sampling pulse $T_{smpn}$ corresponding to the n-th pixel, the sampling flip-flops 21 get digital video data ($D_0$, $D_1$) and hold the digital video data therein. When such video data sampling for the 1st to Nth pixels on a signal scanning line is completed (i.e., sampling corresponding to one horizontal period is completed), an output pulse OE is applied to the holding flip-flops 22. Upon receiving the output pulse OE, the holding flip-flops 22 get the digital video data ($D_0$, $D_1$) from the sampling flip-flops 21, and transfer the digital video data to the decoder 23. The decoder 23 decodes each bit of the digital video data ($D_0$, $D_1$), and turns on one of the analog switches 24 to 27 in accordance with the respective values of the thus decoded bits. As a result, one of the signal voltages $V_0$ to $V_3$ from the four different voltage sources, which corresponds to the thus turned-on analog switch 24, 25, 26, or 27, is output from the circuit 20.

A conventional data driver such as described above requires $2^n$ different voltage sources (where n is the number of bits constituting the digital video data). Accordingly, the number of required voltage sources doubles when the digital video data is enlarged by one bit. For example, in the case where the digital video data consists of 4 bits for displaying 16 gray scale images, the number of required voltage sources is: $2^4=16$. Similarly, in the case where the digital video data consists of 5 bits for displaying 32 gray scale images, the number of required voltage sources is: $2^5=32$. In the case of 6-bit digital video data for displaying 64 gray scale images, the number of required voltage sources is: $2^6=64$.

Such voltage sources are connected through the analog switches of the data driver to a display panel, e.g., a liquid crystal panel, which provides a heavy load on the voltage sources. Thus, each voltage source is required to have a sufficient performance to drive such a heavy load. The increase in the number of high-performance voltage sources is a significant factor which causes the cost of the entire driving circuit to be high. Furthermore, since high-performance voltage sources cannot readily be placed within the LSI circuit of the driving circuit, the voltage sources must be located outside the LSI circuit. This means that signal voltages for driving the liquid crystal panel must be supplied from voltage sources external to the LSI circuit. As a result, with an increase in the number of voltage sources, the number of input terminals of the LSI circuit must be increased accordingly. It is extremely difficult to produce an LSI circuit having such a large number of input terminals. Even if it is possible to make such an LSI circuit, implementing or manufacturing problems arise in the mass production thereof; it is practically impossible to mass-produce such LSI circuits.

To solve the above-described problem, a driving method and a driving circuit using this method is disclosed in Japanese Laid-Open Patent Publication No. 6-27900. In the driving method and driving circuit, external voltage sources for supplying gray-scale reference voltages are used to generate a plurality of interpolated voltages, so that multiple gray scales can be obtained using both the gray-scale reference voltages and the interpolated voltages. This makes it possible to obtain multiple gray scales the number of which is larger than that of the voltage sources. Several types of data drivers using the driving method have been put into practical use.

FIG. 3 shows a circuit 30 which is a part of the data driver in the proposed driving circuit. According to the circuit 30, four interpolated voltages $(V_0+2\ V_2)/3$, $(2\ V_2+V_5)/3$, $(V_2+2\ V_5)/3$, and $(2\ V_5+V_7)/3$ can be obtained from four gray-scale reference voltages $V_0$, $V_2$, $V_5$, and $V_7$ which are supplied from external voltage sources. Accordingly, eight gray scales are realized using only four gray-scale reference voltages.

FIG. 4 shows, by way of example, the waveform of a signal voltage $V_1$ (represented by a solid line) which is output to a data line from the circuit 30 of FIG. 3, and the waveform of a signal voltage $V_{COM}$ (represented by a broken line) applied to a common electrode (not shown) of a liquid crystal panel which is driven by this conventional data driver in accordance with a known alternating driving method. It is assumed in FIG. 4 that the entire driving circuit operates under the ideal condition of no load. The signal voltage $V_1$ is one of the four interpolated voltages described above, which is produced from the gray-scale reference voltages $V_0$ and $V_2$ in the case where the value of the digital video data is 1. As shown in FIG. 4, the signal voltage $V_1$ periodically oscillates between the two gray-scale reference voltages $V_0$ and $V_2$ in such a manner that the ratio of total time for $V_0$ to that for $V_2$ in one output period is 1:2. This conventional data driver operates in accordance with a so-called "line inversion method" in which the polarity of signal voltages is changed from positive to negative or vice versa at the beginning of each horizontal period, thereby preventing the deterioration of the liquid crystal display apparatus. One output period is usually set equal to one horizontal period.

FIG. 5 shows the waveforms of the gray-scale reference voltages $V_0$ and $V_2$, for comparison with the oscillating voltage $V_1$ shown in FIG. 4.

FIG. 6 shows a power supply circuit 63 for supplying the gray-scale reference voltage $V_0$ to the data driver and a power supply circuit 64 for supplying the gray scale reference voltage $V_2$ to the data driver. The power supply circuits 63 and 64 include operational amplifiers 61 and 62, respectively. In the circuit 30 shown in FIG. 3, the gray-scale reference voltages $V_0$ and $V_2$ are supplied to the analog switches 34 and 35, respectively. The circuit 30 generates the oscillating voltage $V_1$ by switching the ON-state and the OFF-state of the analog switches 34 and 35 in accordance with the control signal output from a selective control circuit 33.

FIG. 7 shows a waveform of the gray-scale reference voltage $V_0$ in the case where all of the plurality of circuits 30 output the oscillating voltages $V_1$ in successive horizontal periods. For example, in a VGA type liquid crystal panel, the number of the circuits 30 per scanning line is: 640×3 (RGB)=1920. Assuming that in a certain horizontal period, the oscillating voltages $V_1$ are output from all of the circuits 30 corresponding to one of a plurality of scanning lines in the liquid crystal panel. This corresponds to the fact that a straight line is drawn from one end to the other end of the liquid crystal panel with gray scales corresponding to the voltage level of the oscillating voltages $V_1$. Assuming that in another subsequent horizontal period, the oscillating voltages $V_1$ are output from all of the circuits 30 corresponding to another one of the plurality of scanning lines in the liquid crystal panel. This corresponds to the fact that another straight line is drawn from one end to the other end in the liquid crystal panel with gray scales corresponding to the voltage level of the oscillating voltages $V_1$.

As shown in FIG. 7, voltage changes, like a whisker shape, occur in the gray-scale reference voltage $V_0$. The reason for the voltage changes is as follows:

When the analog switches 34 and 35 shown in FIG. 3 are switched between the ON-state and the OFF-state, there exists time when both of the analog switches 34 and 35 are in the ON-state. This causes a through current flowing between the power supply circuits 63 and 64. Such a noise component in the gray-scale reference voltage $V_0$ (i.e., the voltage changes of the gray-scale reference voltage $V_0$) varies depending upon how many circuits 30 output the oscillating voltage $V_1$. In the above-mentioned VGA type liquid crystal panel, the number of the circuits 30 which output the oscillating voltage $V_1$ is in the range of 0 to 1920 per scanning line.

In the case where the level of the noise component of the gray-scale reference voltage depends upon an image, the noise component possibly changes the average value of the gray-scale reference voltage. The change of the average value of the gray-scale reference voltage may cause deterioration of a whole image such as shadowing. Moreover, the flow of the through current between the power supply circuits 63 and 64 leads to the increase in unnecessary power consumption.

The above-mentioned problems apply to other gray-scale reference voltages in a similar manner.

When a problem arises that the above-mentioned noise component appears in a voltage which is supplied from a voltage source, one of the typical solutions is that a capacitor is provided to prevent the occurrence of the noise component. However, not any capacitor can be used for the gray-scale reference voltage sources such as power supply circuits 63 and 64 shown in FIG. 6. This is because the capacitor itself becomes a load of the voltage source which should output a signal voltage having a rectangular waveform.

SUMMARY OF THE INVENTION

The driving circuit for driving a display apparatus of this invention, comprises: control signal generating means for generating a plurality of control signals in accordance with digital video data; voltage signal output means for receiving the plurality of control signals and selectively outputting at least one of a plurality of voltage signals supplied from voltage supply means in response to the plurality of control signals; and signal delay means, when a predetermined change occurs for each of the plurality of control signals, for transmitting the predetermined change to the voltage signal output means with a predetermined period Δt delayed.

In one embodiment of the present invention, the voltage signal output means complementarily outputs voltage signals which have different levels in one output period.

In another embodiment of the present invention, each of the plurality of control signals has one of a first voltage level and a second voltage level, and the predetermined change is a change of the control signal from the first voltage level to the second voltage level.

In another embodiment of the present invention, the voltage signal output means has a plurality of switching means, each being switched between an ON-state and an OFF-state in response to each of the plurality of control signals, and a voltage signal supplied from the voltage signal supply means to the switching means is output only when the switching means is in the ON-state.

According to another aspect of the present invention, a driving circuit for driving a display apparatus, comprises: control signal generating means for generating a plurality of control signals in accordance with digital video data; and a plurality of switching means, each connected to the control signal generating means, for receiving one of the plurality of control signals and being switched between an ON-state and an OFF-state in response to the received control signal, and a voltage signal supplied from the voltage signal supply means to the switching means is output only when the switching means is in the ON-state, wherein the switching means has a first switching characteristic regarding a change from the ON-state to the OFF-state and a second switching characteristic regarding a change from the OFF-state to the ON-state, and the first switching characteristic is different from the second switching characteristic.

In one embodiment of the present invention, each of the plurality of control signals has one of a first voltage level and a second voltage level, the first switching characteristic includes a first period from a time at which the control signal is changed from the first voltage level to the second voltage level to a time at which the switching means is actually turned on, the second switching characteristic includes a second period from a time at which the control signal is changed from the second voltage level to the first voltage level to a time at which the switching means is actually turned off, and the first period is shorter than the second period.

According to still another aspect of the present invention, a display apparatus comprises a display portion having a plurality of pixels and a driving circuit for driving the display portion, and the driving circuit comprises: control signal generating means for generating a plurality of control signals in accordance with digital video data; voltage signal output means for receiving the plurality of control signals and selectively outputting at least one of a plurality of voltage signals supplied from voltage supply means in response to the plurality of control signals; and signal delay means, when a predetermined change occurs for each of the plurality of control signals, for transmitting the predetermined change to the voltage signal output means with a predetermined period Δt delayed.

According to still another aspect of the present invention, a display apparatus comprises a display portion having a plurality of pixels and a driving circuit for driving the display portion, and the driving circuit comprises: control signal generating means for generating a plurality of control signals in accordance with digital video data; and a plurality of switching means, each connected to the control signal generating means, for receiving one of the plurality of control signals and being switched between an ON-state and an OFF-state in response to the received control signal, and a voltage signal supplied from the voltage signal supply means to the switching means is output only when the switching means is in an ON state, wherein the switching means has a first switching characteristic regarding a change from the ON-state to the OFF-state and a second switching characteristic regarding a change from the OFF-state to the ON-state, and the first switching characteristic is different from the second switching characteristic.

In one embodiment of the present invention, each of the plurality of control signals has one of a first voltage level and a second voltage level, the first switching characteristic includes a first period from a time at which the control signal is changed from the first voltage level to the second voltage level to a time at which the switching means is actually turned on, the second switching characteristic includes a second period from a time at which the control signal is changed from the second voltage level to the first voltage level to a time at which the switching means is actually turned off, and the first period is shorter than the second period.

Thus, the invention described herein makes possible the advantages of (1) providing a driving circuit for a display apparatus, capable of suppressing a noise component of a gray-scale reference voltage, caused in the case where an oscillating voltage is output from the driving circuit in accordance with an oscillating voltage driving method; and (2) providing a display apparatus provided with a driving circuit capable of suppressing a noise component of a gray-scale reference voltage, caused in the case where an oscillating voltage is output from the driving circuit in accordance with an oscillating voltage driving method.

These and other advantages of the present invention will become apparent to those skilled in the art upon reading and understanding the following detailed description with reference to the accompanying figures.

DESCRIPTION OF THE PREFERRED EMBODIMENTS

The present invention will be described by way of illustrative examples with reference to the drawings. A matrix-type liquid crystal display apparatus is herein exemplified as a display apparatus to be driven by a method and a driving circuit according to the present invention. However, it is understood that the method and driving circuit of the present invention can also be applied to other types of display apparatus.

Figure 8:
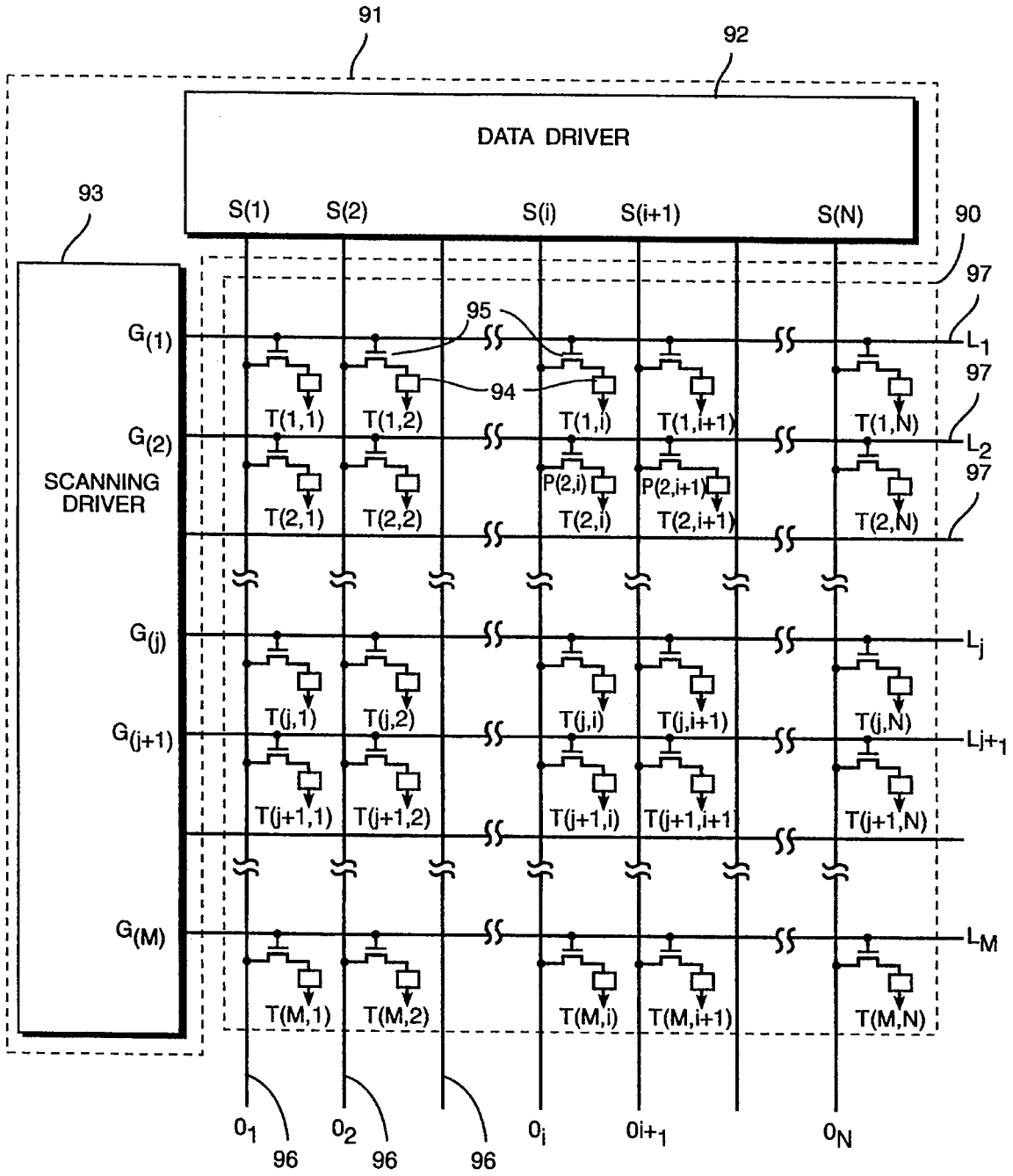
FIG. 8 is a diagram showing a schematic structure of a liquid crystal display apparatus.

FIG. 8 is a schematic diagram showing the structure of a matrix-type liquid crystal display apparatus to be driven by a method and a driving circuit according to the present invention. The liquid crystal display apparatus includes a display section 90 for displaying an image thereon, and a driving circuit 91 for driving the display section 90. The driving circuit 91 includes a data driver 92 and a scanning driver 93 which provide video signals and scanning signals, respectively, to the display section 90. The data driver may be called "a source driver" or "a column driver". The scanning driver may be called "a gate driver" or "a row driver".

The display section 90 includes an M×N array of pixels 94 (M pixels in each column and N pixels in each row; where M and N are positive integers), and also includes switching elements 95 respectively connected to the pixels 94.

The data driver 92 has N output terminals S(i) (i=1, 2, . . . , N). The N output terminals S(i) are respectively connected to the corresponding switching elements 95 by means of N data lines 96. Similarly, the scanning driver 93 has M output terminals G(j) (j=1, 2, . . . , M). The M output terminals G(j) are respectively connected to the corresponding switching elements 95 by means of M scanning lines 97. As the switching elements 95, thin film transistors (TFTs) can be used. Alternatively, other types of switching elements may also be used. The data line may be called "a source line" or "a column line". The scanning line may be called "a gate line" or "a row line".

The scanning driver 93 sequentially outputs a signal voltage which is kept at a high level during a specific time period from its output terminals G(j) to the corresponding scanning lines 97. The specific time period is referred to as one horizontal period jH (where j is an integer of 1 to M). The total length of time obtained by adding up all the horizontal period jH (i.e., 1H+2H+3H+ . . . +MH) is referred to as one vertical period.

When the level of the voltage which is output from the output terminal G(j) to the scanning line 97 is high, the switching element 95 connected to the output terminal G(j) is in the ON-state. When the switching element 95 is in the ON-state, the pixel 94 connected to the switching element 95 is charged in accordance with the voltage which is output from the output terminal S(j) of the data driver 92 to the corresponding data line 96. The voltage of the thus charged pixel 94 remains unchanged for about one vertical period until it is charged again by the subsequent voltage to be supplied from the data driver 92.

Figures 9A, 9B, 9C, 9D, 9E, 9F, 9G, 9H, 9I, 9J:
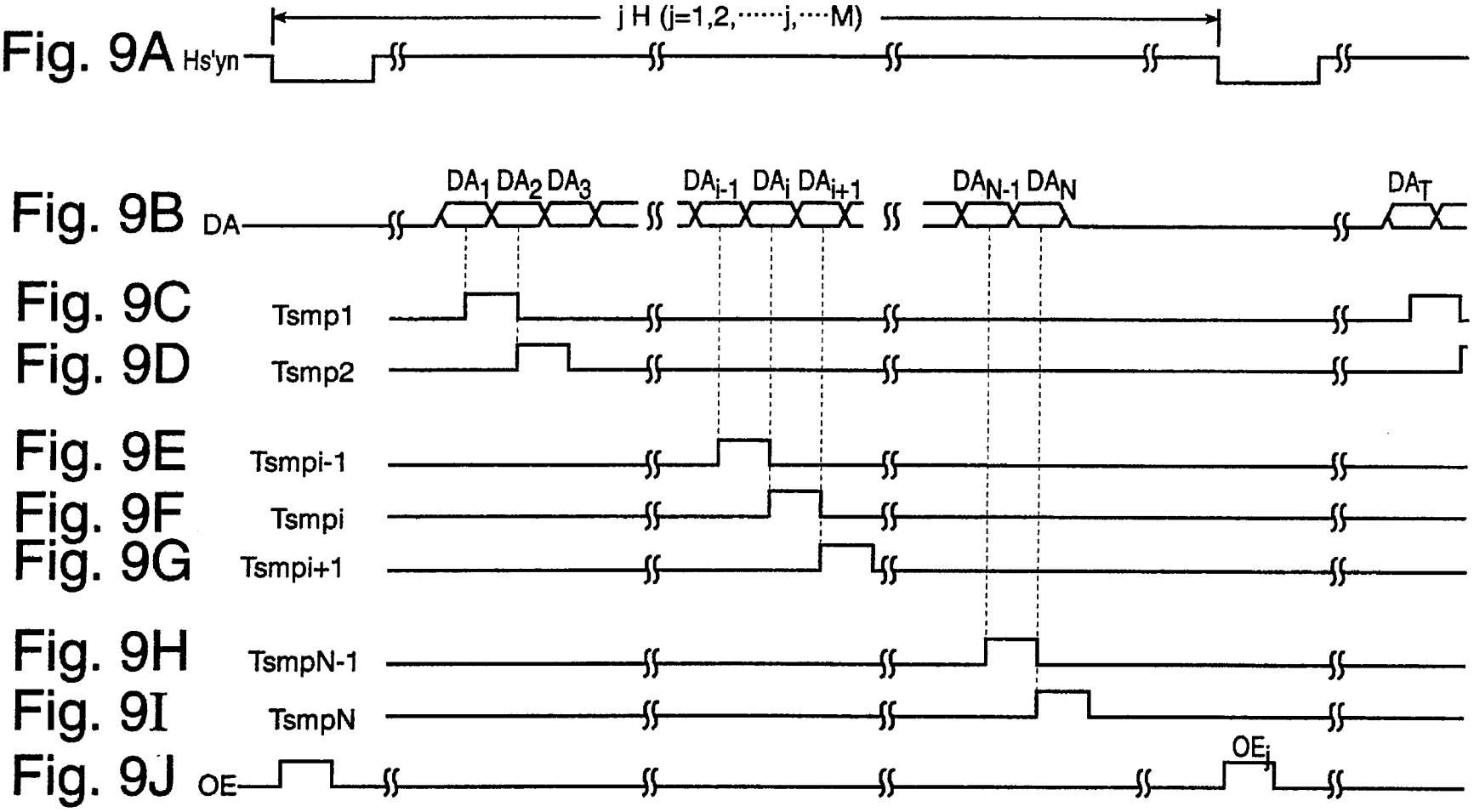
FIG. 9 is a timing chart showing the relation among signals in one horizontal period.

FIG. 9 shows the relationship between digital video data DA, sampling pulses $T_{smpi}$, and an output pulse signal OE, during the j-th horizontal period jH determined by a horizontal synchronizing signal $H_{syn}$. As can be seen from FIG. 9, while sampling pulses $T_{smp1}, T_{smp2}, \ldots, T_{smpi}, \ldots, T_{smpN}$ are sequentially applied to the data driver 92, digital video data $DA_1, DA_2 \ldots, DA_i \ldots, DA_N$ are fed into the data driver 92 accordingly. The j-th output pulse $OE_j$ determined by the output pulse signal OE is then applied to the data driver 92. On receiving the j-th output pulse $OE_j$, the data driver 92 outputs voltages in accordance with the digital video data $DA_1$ to $DA_N$, respectively from its output terminals S(1) to S(N) to the corresponding data lines 96.

Figures 10A, 10B, 10C, 10D, 10E, 10F, 10G, 10H, 10I, 10J, 10K:
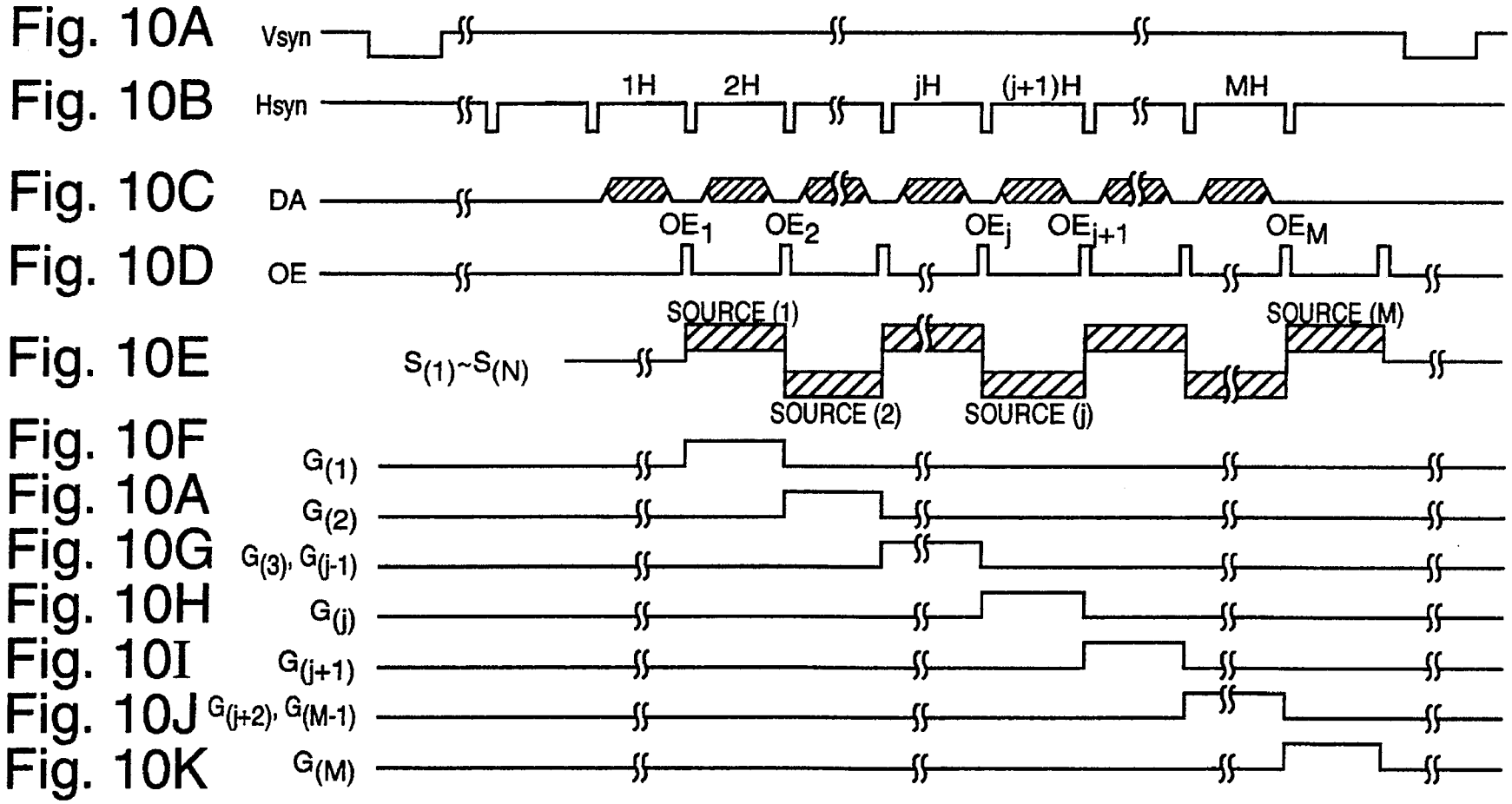
FIG. 10 is a timing chart showing the relation among signals in one vertical period.

FIG. 10 shows the relationship between the horizontal synchronizing signal $H_{syn}$, the digital video data DA, the output pulse signal OE, and the timing of outputs of the data driver 92 and scanning driver 93, during one vertical period determined by a vertical synchronizing signal $V_{syn}$. In FIG. 10, a SOURCE (j) indicates the levels of voltages output from the data driver 92, with such timing as shown in FIG. 9 and in accordance with the N sets of digital video data DA which have been fed into the data driver 92 during the j-th horizontal period jH. The SOURCE (j) is shown as a hatched rectangular area to indicate a range of voltages output from all the N output terminals S(1) to S(N) of the data driver 92. While the voltages indicated by the SOURCE (j) are applied to the data lines 96, the voltage which is output from the j-th output terminal G(j) of the scanning driver 93 to the j-th scanning line 97 is changed to and kept at a high level, thereby turning on all the N switching elements 95 connected to the j-th scanning line 97. As a result, the N pixels 94 respectively connected to these N switching elements 95 are charged in accordance with the voltage applied to the corresponding data lines 96 from the data driver 92.

The above-described process is repeated M times, i.e., for the 1st to Mth scanning lines 97, so that an image corresponding to one vertical period is displayed. In the case of non-interlace type display apparatus, the produced image serves as a complete display image on the display screen thereof.

In this specification, the time interval between the j-th output pulse $OE_j$ and the (j+1)-th output pulse $OE_{j+1}$ in the output pulse signal OE is referred to as "one output period". This means that one output period is equal to a period represented by SOURCE (j) shown in FIG. 10. In cases where ordinary linear sequential scanning is performed, it is preferable that one output period is made equal to one horizontal period. The reason for this is as follows. While the data driver 92 outputs, to the data lines 96, voltages corresponding to digital video data for one horizontal (scanning) line, it also performs sampling of digital video data for the next horizontal line. The maximum allowance length of time during which these voltages can be output from the data driver 92 is equal to one horizontal period. Furthermore, except for special cases, as the output period becomes longer, the pixels can be charged more accurately. In the driving circuit described herein, therefore, one output period is equal to one horizontal period. According to the present invention, however, one output period is not necessarily required to be equal to one horizontal period.

Figure 11:
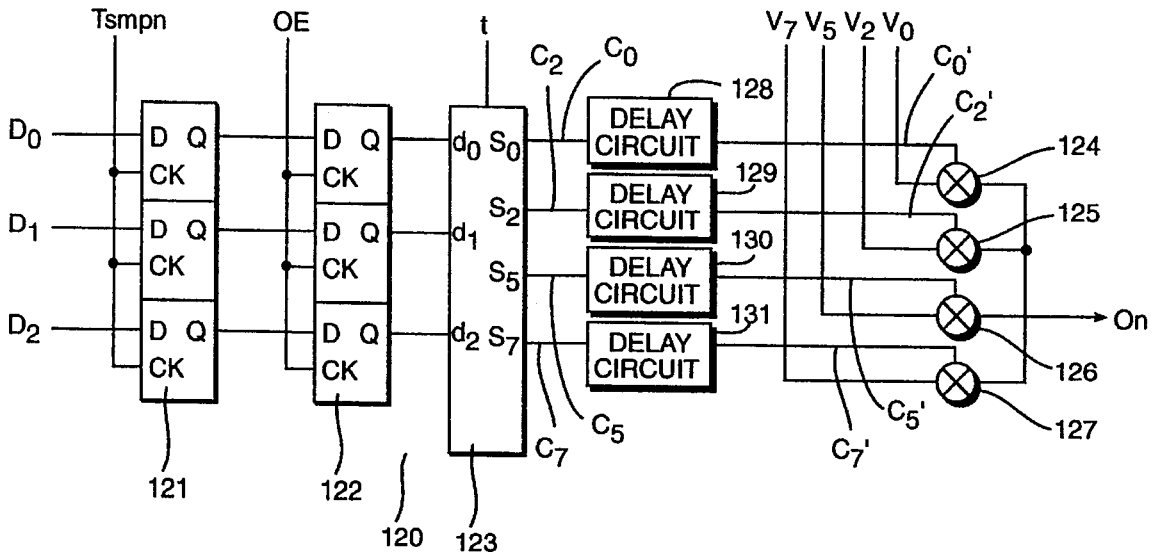
FIG. 11 is a partial circuit diagram of a data driver shown in FIG. 8.

FIG. 11 shows a circuit which is a part of the data driver 92 in the driving circuit 90. This circuit is denoted by the reference numeral 120. The circuit 120 outputs a signal voltage from the n-th output terminal S(n) to the corresponding data line 96 (where n is an integer of 1 to N). In this example, it is assumed that digital video data consists of three bits ($D_0$, $D_1$, $D_2$).

The circuit 120 includes sampling flip-flops 121 and holding flip-flops 122 for receiving and holding the respective bits of the digital video data ($D_0$, $D_1$, $D_2$). The circuit 120 also includes a selective control circuit 123, signal delay circuits 128 to 131, and four analog switches 124 to 127. The selective control circuit 123 generates a plurality of control signals for controlling the ON/OFF-state of the analog switches 124 to 127 individually in accordance with the received digital video data. The signal delay circuits 128 to 131 respectively receive the plurality of control signals and output the control signals thus received after the elapse of a predetermined period of time. The analog switches 124 to 127 receive the control signals delayed by the signal delay circuits 128 to 131 and are turned on or off in response to the control signals. Gray-scale reference voltages $V_0$, $V_2$, $V_5$, and $V_7$ having different levels are supplied to the analog switches 124 to 127, respectively. A signal t is supplied to the selective control circuit 123.

Next, the operation of the circuit 120 will be described with reference to FIG. 11.

At a rising edge of the sampling pulse $T_{smpn}$ corresponding to the n-th pixel, the sampling flip-flops 121 get the respective bits of the digital video data ($D_0$, $D_1$, $D_2$) and hold the digital video data in the sampling flip-flops 121. When sampling corresponding to one horizontal period is completed, an output pulse OE is applied to the holding flip-flops 122. On receiving the output pulse OE, the holding flip-flops 122 get the digital video data ($D_0$, $D_1$, $D_2$) from the sampling flip-flops 121, and also output the received digital video data to the selective control circuit 123. The selective control circuit 123 has input terminals $d_0$, $d_1$ and $d_2$, and output terminals $S_0$, $S_2$, $S_5$ and $S_7$. The three bits of the digital video data ($D_0$, $D_1$, $D_2$) are input to the input terminals $d_0$, $d_1$ and $d_2$ of the selective control circuit 123, respectively. Through the output terminals $S_0$, $S_2$, $S_5$ and $S_7$, the selective control circuit 123 outputs control signals $c_0$, $c_2$, $c_5$ and $c_7$ respectively for turning on or off the analog switches 124 to 127 so as to control the ON/OFF-state thereof.

Table 1 is a logical table showing the relationship between inputs and outputs of the selective control circuit 123. The first section of Table 1, containing columns $d_2$, $d_1$, and $d_0$, shows the values of the three bits of digital video data which are respectively input to the input terminals $d_2$, $d_1$ and $d_0$ of the selective control circuit 123. The second section of Table 1, containing columns $S_0$, $S_2$, $S_5$, and $S_7$, shows the values of control signals $c_0$, $c_2$, $c_5$ and $c_7$ which are respectively output from the output terminals $S_0$, $S_2$, $S_5$ and $S_7$ of the selective control circuit 123. A blank portion in the second column of Table 1 indicates that the value of the control signal is 0. The symbol "t" indicates that the control signal has a value of 1 when the signal t has a value of 1, and that the control signal has a value of 0 when the signal t has a value of 0. The symbol "$\bar{t}$" indicates that the control signal has a value of 0 when the signal t has a value of 1, and that the control signal has a value of 1 when the signal t has a value of 0.

TABLE 1

| $d_2$ | $d_1$ | $d_0$ | $S_0$ | $S_2$ | $S_5$ | $S_7$ |
|---|---|---|---|---|---|---|
| 0 | 0 | 0 | 1 | | | |
| 0 | 0 | 1 | $\bar{t}$ | t | | |
| 0 | 1 | 0 | | 1 | | |
| 0 | 1 | 1 | | t | $\bar{t}$ | |
| 1 | 0 | 0 | | $\bar{t}$ | t | |
| 1 | 0 | 1 | | | 1 | |
| 1 | 1 | 0 | | | t | $\bar{t}$ |
| 1 | 1 | 1 | | | | 1 |

The signal t is a pulse signal which periodically alternates between a value of 0 and a value of 1 with a duty ratio of 1:2. Specifically, the ratio of the time period when the signal t has a value of 0 to the time period when the signal t has a value of 1 is 1:2.

In this example shown in Table 1, when the values of the three bits input to the input terminals $d_2$, $d_1$ and $d_0$ are 0, 0 and 1, respectively, the control signal $c_0$ output from the output terminal $S_0$ has values which are equal to those of the signal $\bar{t}$, and the control signal $c_2$ output from the output terminal $S_2$ has values which are equal to those of the signal t. As a result, the control signals $c_0$ and $c_2$ oscillate between 0 and 1 in the same cycle as that of the signal t, so that the control signals $c_0$ and $c_2$ have complementary values all of the time.

The signal delay circuits 128 to 131 delay the timing of the change in input signal from a low level to a high level by a predetermined period Δt. Herein, a control signal input to the signal delay circuits 128 to 131 is denoted by $c_i$ and a signal output therefrom is denoted by $c_i'$. The timing at which the signal $c_i'$ changes from a low level to a high level is delayed by Δt compared with the timing at which the signal $c_i$ changes from a low level to a high level. The control signal $c_0'$ is identical to the control signal $c_0$ except for the delay Δt.

Figure 12:
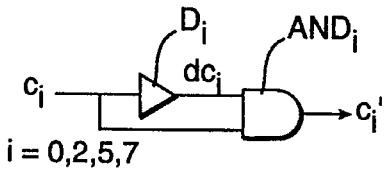
FIG. 12 is a diagram showing the structure of a signal delay circuit.

FIG. 12 shows an exemplary circuit for the signal delay circuits 128 to 131. This circuit includes an input terminal, an output terminal, a delay element $D_i$ for delaying a signal by a predetermined time period, and a two-input AND element $AND_i$. The delay element $D_i$ is, for example, implemented by connecting an appropriate number of buffers having a long rise time in series. The output terminal $S_i$ of the selective control circuit 123 is connected to the input terminal of the delay element $D_i$ and one input terminal of the two-input AND element $AND_i$. The output terminal of the delay element $D_i$ is connected to the other input terminal of the two-input AND element $AND_i$. The output terminal of the two-input AND element $AND_i$ is connected to the corresponding analog switch. The delay element $D_i$ receives the control signal $c_i$ and outputs a control signal $dc_i$ which is delayed by a predetermined period of time compared with the signal $c_i$. The two-input AND element $AND_i$ receives the control signal $c_i$ and the delayed control signal $dc_i$ and performs AND operation between the control signal $c_i$ and the control signal $dc_i$ so as to produce a control signal $c_i'$. As a result, the control signal $c_i'$ is supplied to the corresponding analog switch. Herein, i is 0, 2, 5, or 7.

Figure 13:
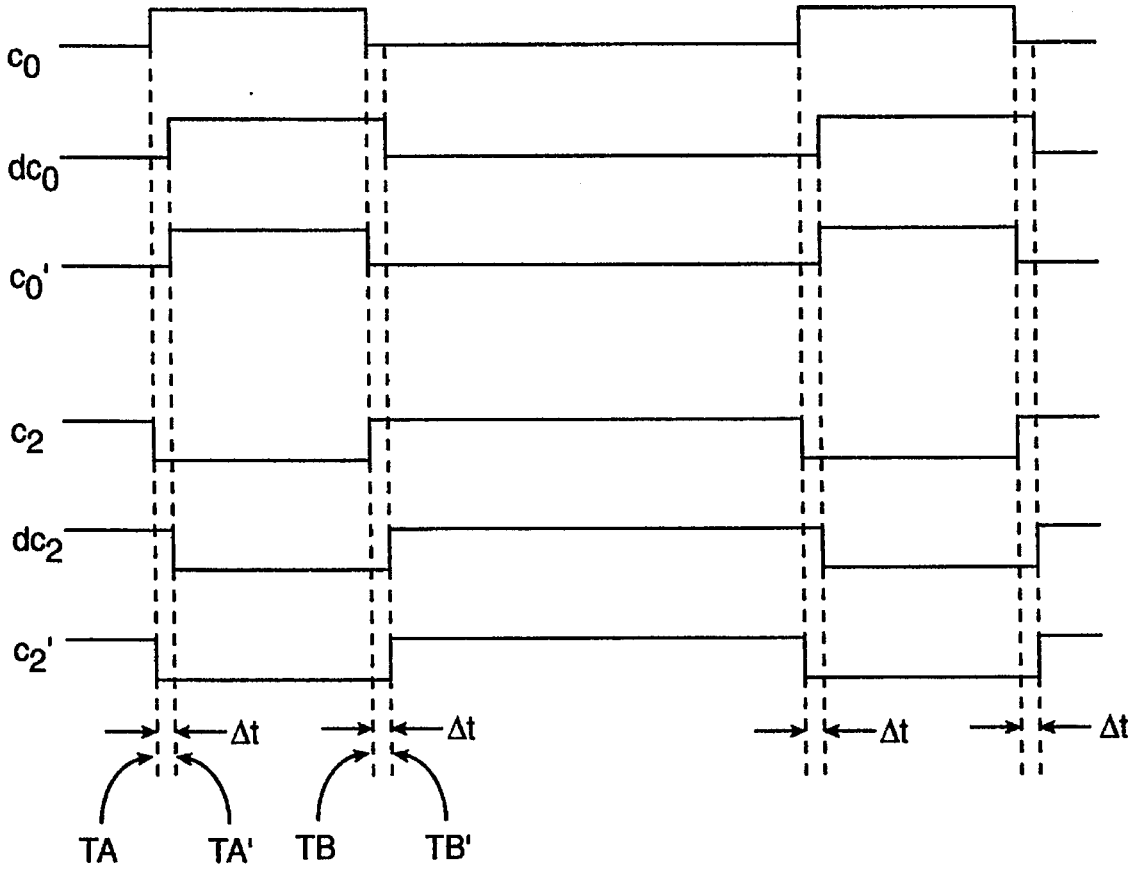
FIG. 13 is a timing chart showing the relations among control signals $c_0$ and $c_2$, control signals $dc_0$ and $dc_2$, and control signals $c_0'$ and $c_2'$.

FIG. 13 shows waveforms of the control signals $c_0$ and $c_2$, the control signals $dc_0$ and $dc_2$, and the control signals $c_0'$ and $c_2'$ in the case where the control signals $c_0$ and $c_2$ oscillate between 0 and 1 in the same cycle as that of the signal t. In this example, it is assumed that the delay elements $D_0$ and $D_2$ cause a delay of Δt. As shown in FIG. 13, a time TA' at which the control signal $c_0'$ is changed from a low level to a high level is delayed by Δt compared with a time TA at which the control signal $c_2'$ is changed from a high level to a low level. Similarly, a time TB' at which the control signal $c_2'$ is changed from a low level to a high level is delayed by Δt compared with a time TB at which the control signal $c_0'$ is changed from a high level to a low level. Thus, by providing the delay period Δt, the control signals $c_0'$ and $c_2'$ are not changed simultaneously. Accordingly, there is no time at which both of the control signals $c_0'$ and $c_2'$ are at a high level.

Figure 14:
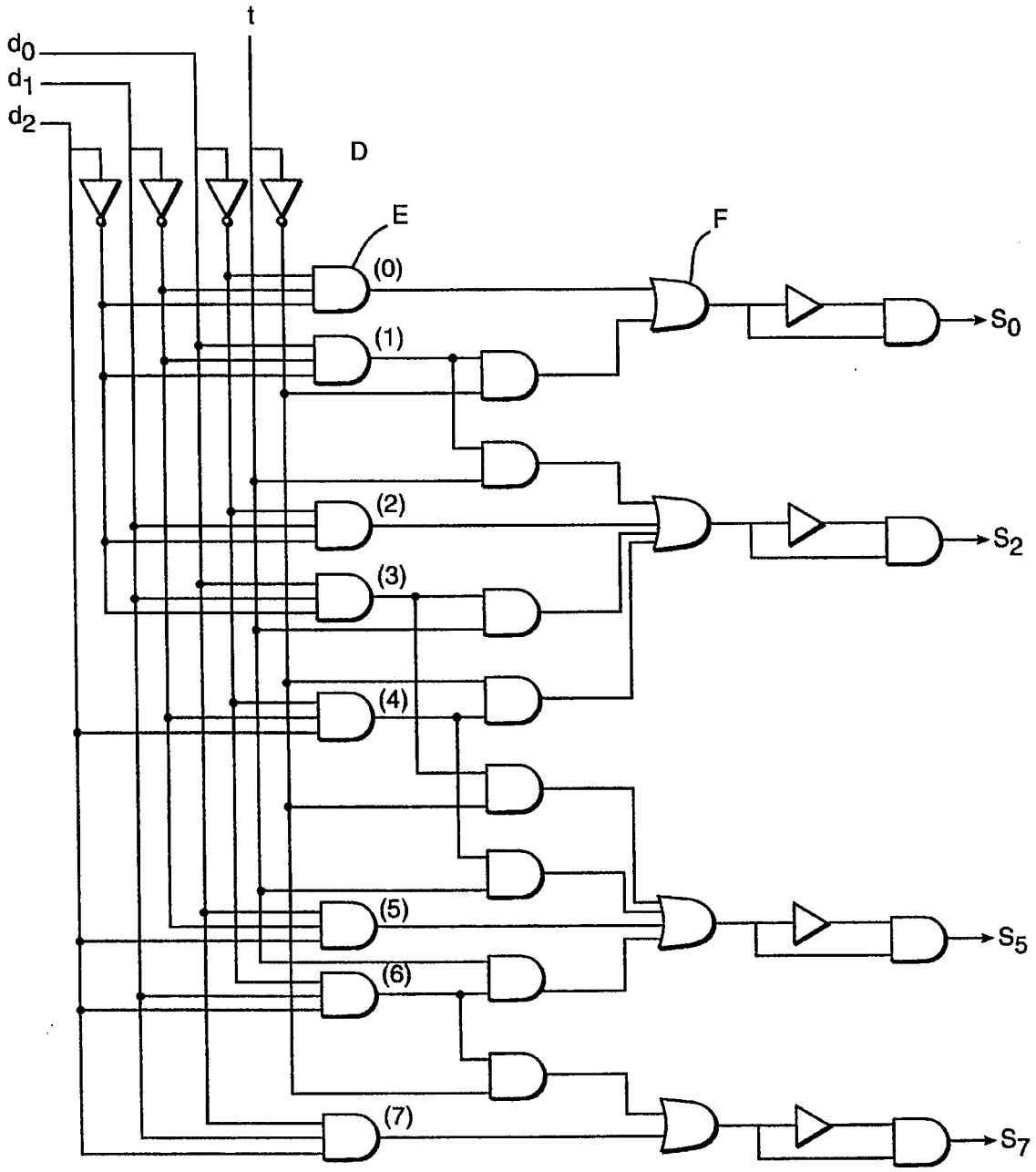
FIG. 14 is a diagram showing the structure of a selective control circuit shown in FIG. 11.

The signal delay circuits 128 to 131 of FIG. 11 can be incorporated into the selective control circuit 123. FIG. 14 shows an exemplary circuit structure of the selective control circuit 123.

Referring back to FIG. 11, the gray-scale reference voltages $V_0$, $V_2$, $V_5$ and $V_7$ having different voltage levels are supplied to the four analog switches 124 to 127, respectively. These voltages satisfy the relationship of: $V_0<V_2<V_5<V_7$ or $V_7<V_5<V_2<V_0$. As a circuit for supplying such voltages, for example, the power supply circuits 63 and 64 can be used. The analog switches 124 to 127 each has a control terminal. The control terminals of the analog switches 124 to 127 are connected to the signal delay circuits 128 to 131, respectively. The control signals $c_0'$, $c_2'$, $c_5'$, and $c_7'$ are supplied to the analog switches 124 to 127 through the respective corresponding control terminals. Each of the analog switches 124 to 127 is in the ON-state, when it receives the control signal with a high level (e.g., 1). On the other hand, each of the analog switches 124 to 127 is in the OFF-state, when it receives the control signal with a low level (e.g., 0). A voltage supplied to each of analog switches 124 to 127 is output to the data line 96, only when the analog switch is in the ON-state.

As described above, even in the case where the analog switches 124 and 125 are required to be switched between the ON-state and the OFF-state in order to generate the oscillating voltage $V_1$ which oscillates between the voltages $V_0$ and $V_2$, there is no time at which both of the control signals $c_0'$ and $c_2'$ are at a high level. Accordingly, there is no time at which both of the analog switches 124 and 125 are in the ON-state. This makes it possible to prevent a through current from flowing between the voltage supply circuit 63 which supplies the voltage $V_0$ and the voltage supply circuit 64 which supplies the voltage $V_2$ in switching the ON/OFF state of analog switches 124 and 125.

A through current can be prevented in a similar manner even when oscillating voltages other than the voltage $V_1$ are generated.

Figure 1:
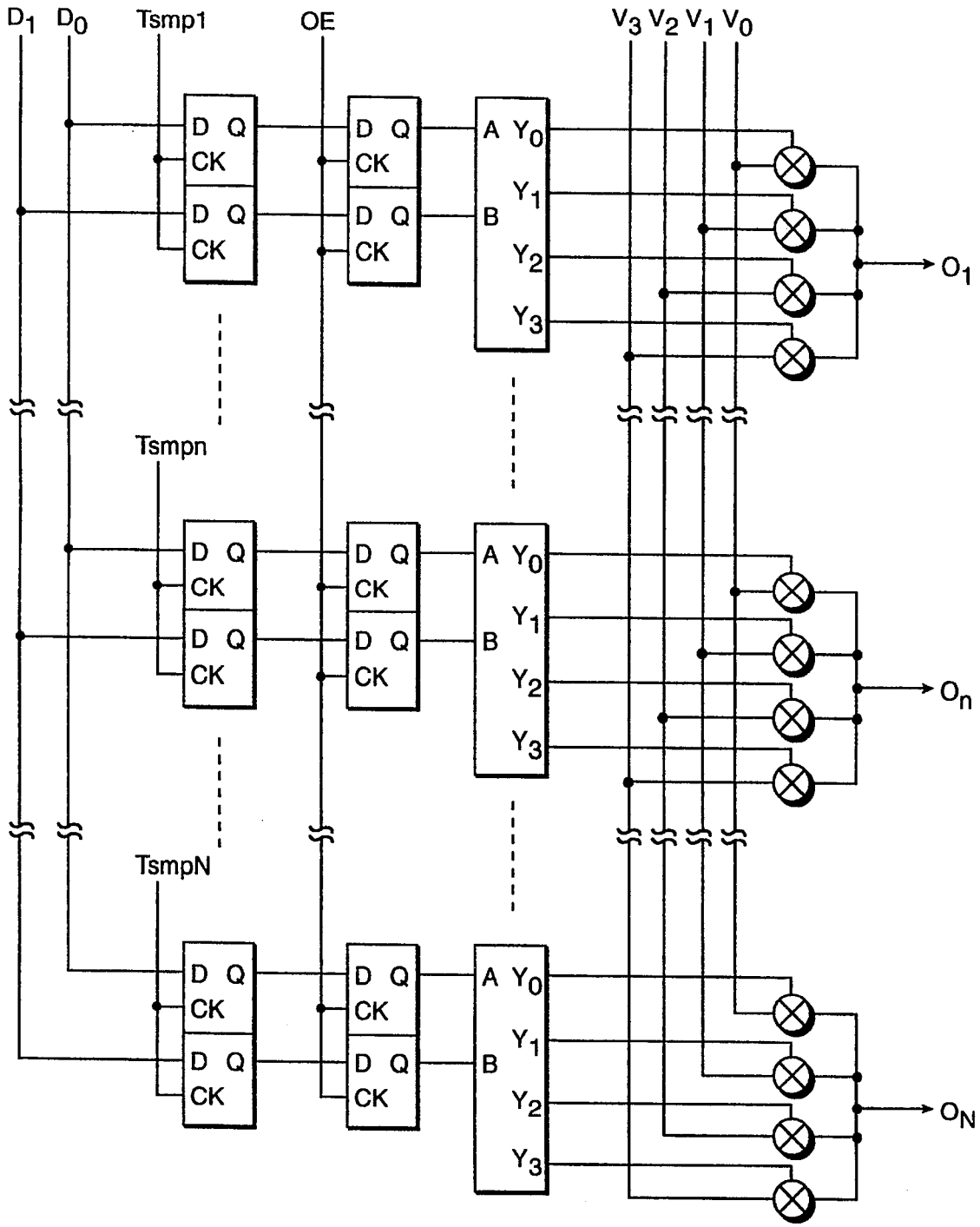
Fig. 1 (PRIOR ART)
FIG. 1 is a schematic circuit diagram of a conventional data driver.
Figure 2:
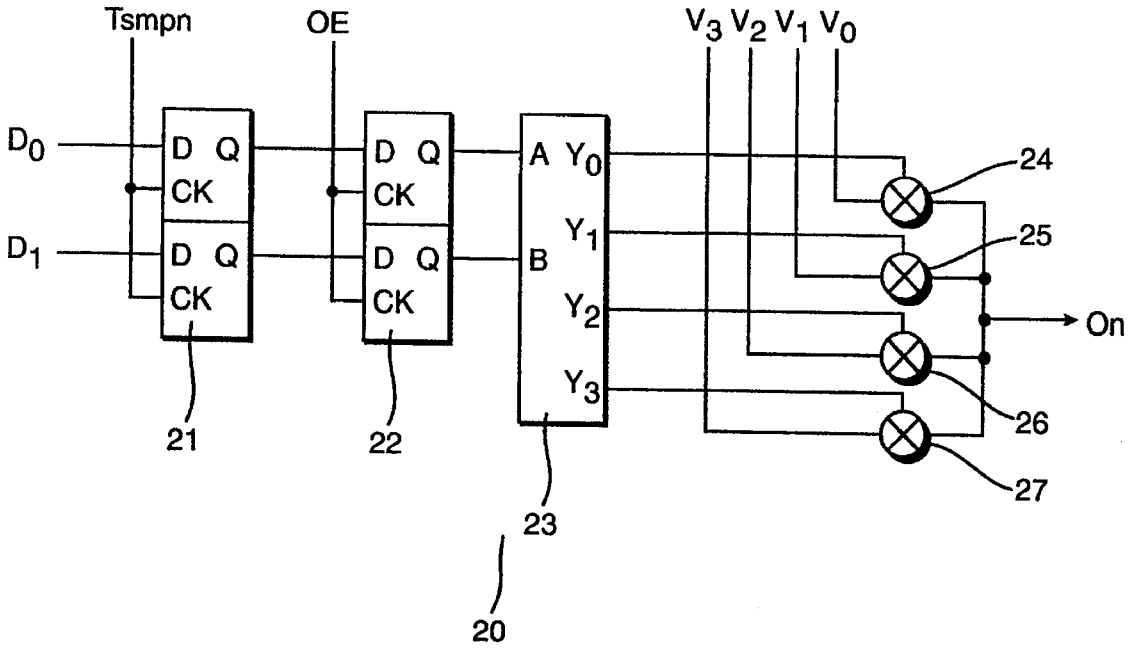
Fig. 2 (PRIOR ART)
FIG. 2 is a schematic circuit diagram showing part of the conventional data driver of FIG. 1.
Figure 3:
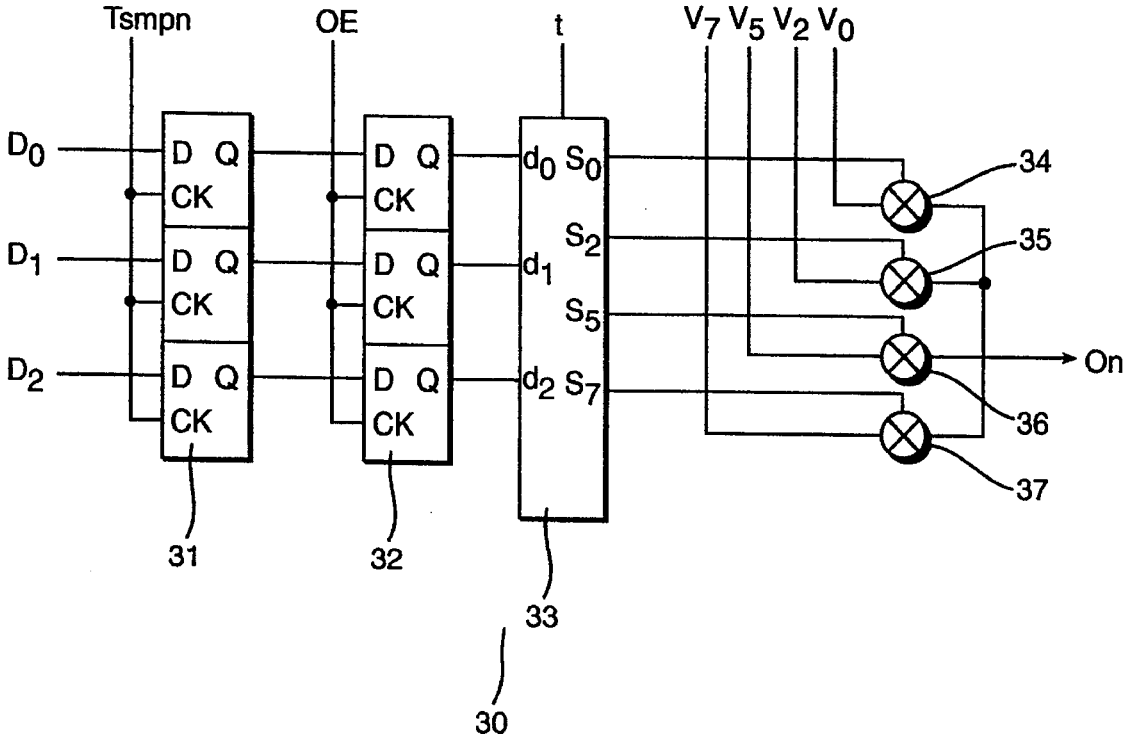
FIG. 3 is a schematic circuit diagram showing part of another conventional data driver.
Figure 4:
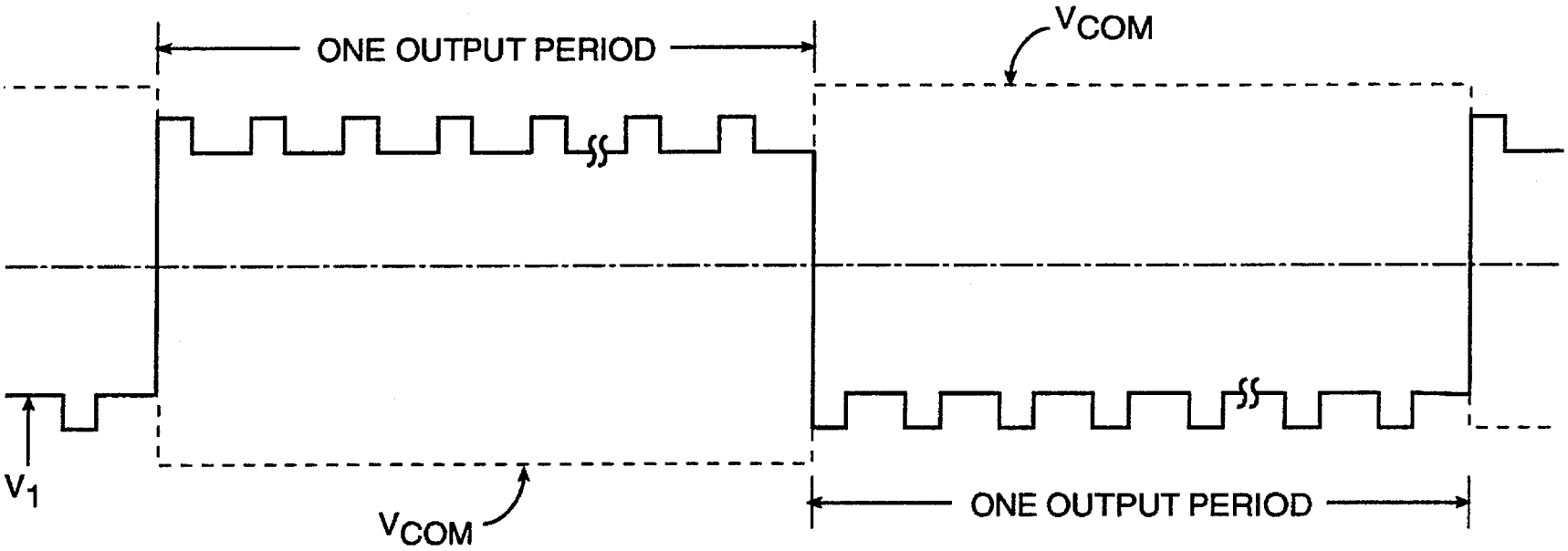
FIG. 4 shows the waveforms of an oscillating voltage $V_1$ and a signal voltage $V_{COM}$.
Figure 5:
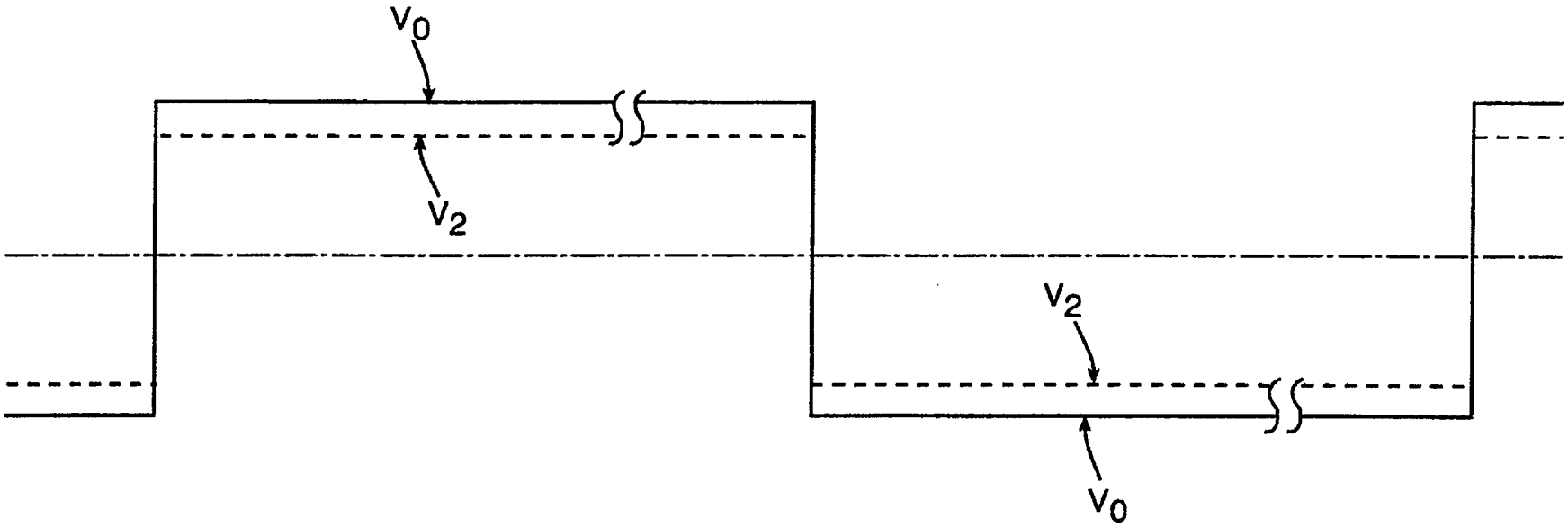
Fig. 5 (PRIOR ART)
FIG. 5 shows the waveforms of gray-scale reference voltages $V_0$ and $V_2$.
Figure 6:
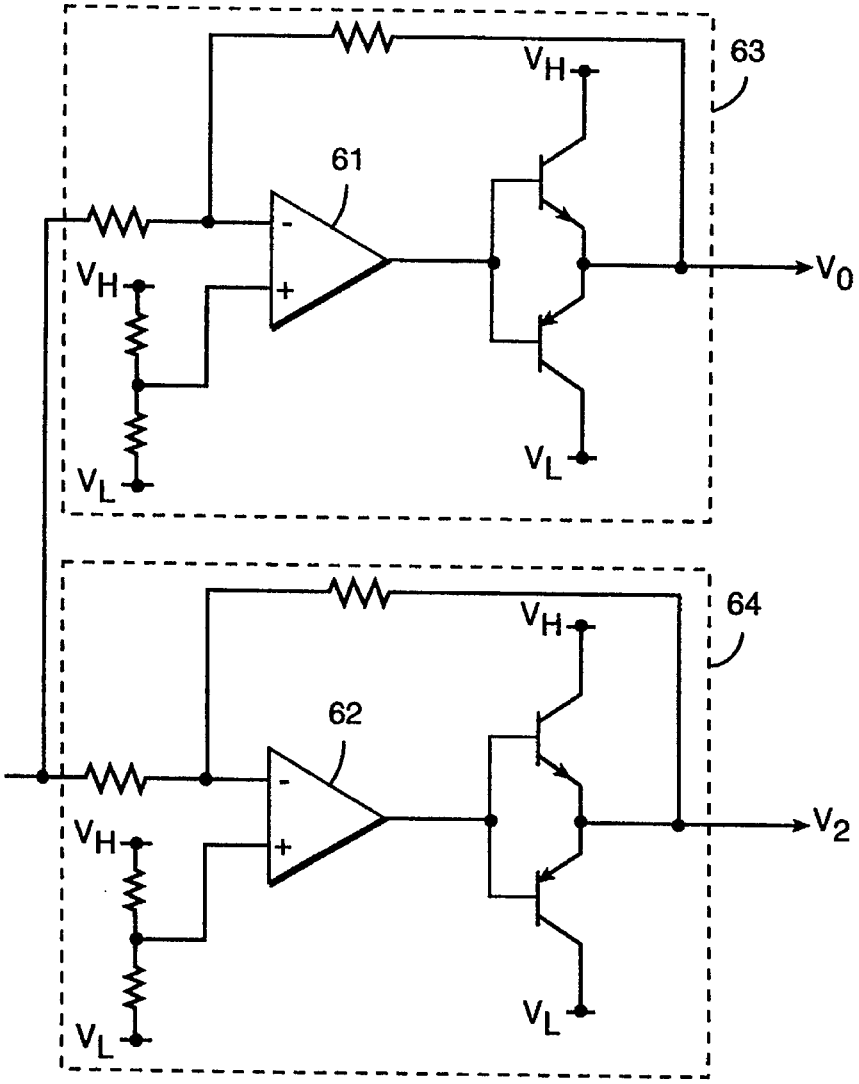
Fig. 6 (PRIOR ART)
FIG. 6 is a schematic diagram showing power supply circuits for supplying gray-scale reference voltages $V_0$ and $V_2$.
Figure 7:
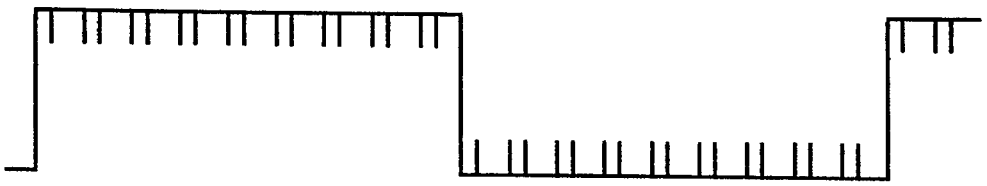
Fig. 7 (PRIOR ART)
FIG. 7 is a diagram showing a noise component caused in the gray-scale reference voltage.
Figure 15:
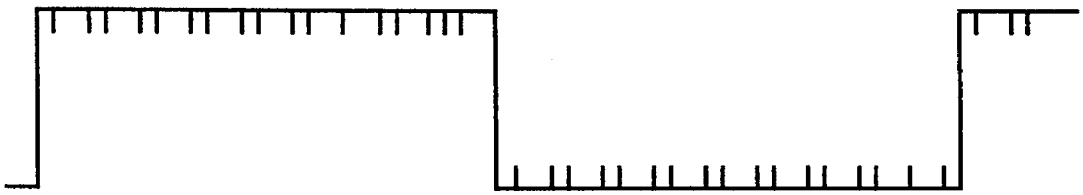
FIG. 15 is a diagram showing a reformed waveform of the gray-scale reference voltage.

FIG. 15 shows an improved waveform of the gray-scale reference voltage $V_0$ in a case where the circuit 120 shown in FIG. 11 is used as a driving circuit. From the comparison between the waveform of the gray-scale reference voltage of FIG. 15 and the waveform of the gray-scale reference voltage of FIG. 7, it is understood that a noise component, like a whisker shape, caused in the gray-scale reference voltage is almost eliminated.

Alternatively, the through current can be prevented by regulating the rising characteristics in the case where the analog switches 124 to 127 turn on or turn off.

Figure 16:
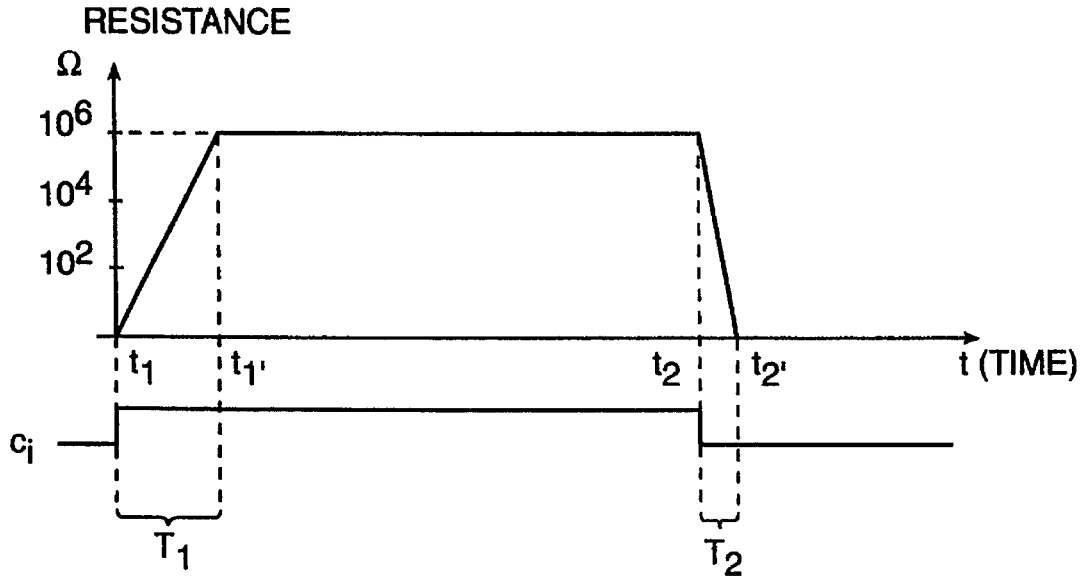
FIG. 16 is a diagram showing a switching characteristic of an analog switch.

FIG. 16 shows the exemplary rising characteristics of the respective analog switches 124 to 127. The horizontal axis represents a time t and the vertical axis represents a resistance value of the analog switch. When the resistance value of the analog switch is $10^6$ (Ω), the analog switch is substantially in the OFF-state. When the resistance value of the analog switch is 0 (Ω), the analog switch is in the ON-state. A period from a time $t_1$ at which the control signal $c_i$ is changed from a low level to a high level to a time $t_1'$ at which the analog switch is actually turned off is denoted by $T_1$ ($=t_1'-t_1$), and a period from a time $t_2$ at which the control signal $c_i$ is changed from a high level to a low level to a time $t_2'$ at which the analog switch is actually turned on is denoted by $T_2$($=t_2'-t_2$), as is shown in FIG. 16. In the case where the period $T_2$ is shorter than the period $T_1$, there is no time at which two or more analog switches of the analog switches 124 to 127 are in the ON-state simultaneously. Therefore, the same effects as those of the above example can be obtained. The analog switch having the rising characteristics shown in FIG. 16 can be obtained, for example, by unbalancing p-type and n-type characteristics of the analog switch.

According to the present invention, two or more analog switches in a driving circuit are not simultaneously changed from the OFF-state to the ON-state, when the driving circuit outputs an oscillating voltage in accordance with an oscillating voltage driving method. As a result, a through current can be prevented from flowing between voltage supply circuits and a noise component in a gray-scale reference voltage can be prevented. In addition, unnecessary power consumption can be prevented.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A driving circuit for driving a display apparatus in accordance with digital video data received by the driving circuit, comprising:

an input means for receiving a plurality of voltage signals;

control signal generating means for generating a plurality of control signals in accordance with the digital video data;

voltage signal output means for receiving the plurality of control signals and selectively outputting at least one of the plurality of voltage signals to charge a pixel in said display apparatus, wherein the at least one voltage signal is applied in response to at least one of the plurality of control signals; and signal delay means for delaying by a predetermined delay period the transmission of at least one and less than all of the plurality of control signals to the voltage signal output means when a predetermined change occurs to the control signals.

2. A driving circuit according to claim 1, wherein the voltage signal output means complementarily outputs voltage signals which have different levels in one output period.

3. A driving circuit according to claim 1, wherein each of the plurality of control signals is a first value or a second value, and the predetermined change is a change of the control signal from the first value to the second value.

4. A driving circuit according to claim 1, wherein the voltage signal output means has a plurality of switching means, each being switched between an ON-state and an OFF-state in response to each of the plurality of control signals, and a voltage signal supplied from the voltage signal supply means to the switching means is output only when the switching means is in the ON-state.

5. A driving circuit for driving a display apparatus in accordance with digital video data received by the driving circuit, comprising:

an input means for receiving a plurality of voltage signals;

control signal generating means for generating a plurality of control signals in accordance with the digital video data; and a plurality of switching means, each operatively connected to the control signal generating means, switching between an ON-state and an OFF-state in response to the changing of control signals, and one of the voltage signals supplied via the input means to the switching means is output to charge a pixel in said display apparatus by the switching means only when the switching means is in the ON state, wherein the switching means has a first switching characteristic when changing from the ON-state to the OFF-state and a second switching characteristic when changing from the OFF-state to the ON-state and wherein each of the plurality of control signals is either a first value or a second value, the first switching characteristic includes a first period from a time at which the value of the control signal changes from the first value to the second value to a time at which the switching means is actually turned on, the second switching characteristic includes a second period from a time at which the value of the control signal changes from the second value to the first value to a time at which the switching means is actually turned off, and the first period is shorter than the second period so that the timing of transmissions of control signals at said second value is delayed relative to the timing of transmissions of control signals at said first value.

6. A display apparatus comprising a display portion having a plurality of pixels and a driving circuit for driving the display portion in accordance with digital video data received by the driving circuit, the driving circuit comprising:

an input means for receiving a plurality of voltage signals;

control signal generating means for generating a plurality of control signals in accordance with the digital video data;

voltage signal output means for receiving the plurality of control signals from the control signal generating means and the voltage signals from the input means, and selectively outputting at least one of the plurality of voltage signals to charge a pixel in said display apparatus, wherein said at least one of the plurality of voltage signals are outputted to the pixel in response to the plurality of control signals; and signal delay means, when a predetermined change occurs in the plurality of control signals, for transmitting the predetermined change to the voltage signal output means delayed by a predetermined period, wherein said signal delay means delays the transmission of at least one and less than all of the plurality of control signals.

7. A display apparatus comprising a display portion having a plurality of pixels and a driving circuit for driving the display portion in accordance with digital video data received by the driving circuit, the driving circuit comprising:

an input means for receiving a plurality of voltage signals;

control signal generating means for generating a plurality of control signals in accordance with the digital video data; and a plurality of switching means, each operatively connected to the control signal generating means, for switching between an ON-state and an OFF-state in response to the control signals, and one of the voltage signals supplied via the input means to the switching means is output by the switching means to charge a pixel in said display apparatus only when the switching means is in an ON state, wherein the switching means has a first switching characteristic regarding a change from the ON-state to the OFF-state and a second switching characteristic regarding a change from the OFF-state to the ON-state, and wherein each of the plurality of control signals is either a first value or a second value, the first switching characteristic includes a first period from a time at which the value of the control signal changes from the first value to the second value to a time at which the switching means is actually turned on, the second switching characteristic includes a second period from a time at which the value of the control signal changes from the second value to the first value to a time at which the switching means is actually turned off, and the first period is shorter than the second period such that the timing of transmissions of control signals at said second value is delayed relative to the timing of transmissions of control signals at said first value.

8. A method for driving a display apparatus having a driving circuit including a selector, delay circuit, source of voltage levels, and a voltage switching circuit, the method comprising:

a. encoding digital video data in the selector circuit to generate voltage control signals;

b. transmitting the voltage control signals to the voltage switching circuit through the delay circuit, wherein the transmission of certain control signal changes are substantially delayed as compared to the transmission of other control signals changes;

c. selecting at least one of the voltage levels by the voltage switching circuit when each of the control signals are received by the switching circuit, wherein each control signal corresponds to a unique set of at least one of the voltage levels and the switching circuit selects the unique set corresponding to the received control signal, and d. outputting the selected unique set of at least one of the voltage levels from the driving circuit to a display circuit.

9. A method for driving a display as in claim 8 wherein in (b) the control signal changes that are delayed are changes from a first signal level to a second signal level, wherein control signal changes from the second to the first signal levels are not delayed.

10. A driver circuit for applying digital video data to drive a liquid crystal display apparatus having a pixel display matrix comprising:

voltage source providing a plurality of different voltage levels to the driving circuit;

a selector circuit encoding the digital video data into switching control signals, wherein each control signal corresponds to a unique set of at least one of the voltage levels;

a delay circuit receiving the switching control signals from the selector circuit and transmitting the control signals to a voltage switch circuit, wherein the delay circuit imparts a delay to the transmission of certain predetermined control signal changes relative to the transmission of other control signal changes;

the voltage switch circuit selectively couples a first set of the unique set of at least one of the voltage levels to the pixel display matrix in upon receipt of a first control signal corresponding to the first set and coupling a second set of the unique set of at least one of the voltage levels to the pixel display matrix upon receipt of a control signal corresponding to the second set.

11. A driving circuit for applying digital video data to drive a liquid crystal display apparatus having a pixel display matrix comprising:

voltage source providing a plurality of different voltage levels to the driving circuit;

a selector circuit encoding the digital video data into switching control signals, wherein each control signal corresponds to a unique set of at least one of the voltage levels;

a delay circuit receiving the switching control signals from the selector circuit and transmitting the control signals to a voltage switch circuit, wherein the delay circuit imparts a delay to the transmission of certain predetermined control signal changes relative to the transmission of other control signal changes, wherein said delay circuit comprises a control signal delay element having an input for receiving control signals from the selector circuit and a control signal output, and an AND circuit having a first input receiving the control signal delay element output and a second input receiving the control signal from the selector circuit and an output of the AND circuit coupled to the voltage switch circuit;

the voltage switch circuit selectively couples a first set of the unique set of at least one of the voltage levels to the pixel display matrix in upon receipt of a first control signal corresponding to the first set and coupling a second set of the unique set of at least one of the voltage levels to the pixel display matrix upon receipt of a control signal corresponding to the second set.

12. A driving circuit as in claim 11 wherein the control signal delay element is a series of cascading buffer circuits.

* * * * *